US005078156A

United States Patent [19]

Furuya et al.

[11] Patent Number: 5,078,156

[45] Date of Patent: Jan. 7, 1992

[54] METHOD AND APPARATUS FOR PRODUCING SHEET TOBACCO

[75] Inventors: Norio Furuya, Hamamatsu; Shinji Kaneda, Tokyo; Masaaki Kobayashi, Hamamatsu; Kenichi Nomura, Odawara, all of Japan

[73] Assignee: Japan Tobacco Inc., Tokyo, Japan

[21] Appl. No.: 649,588

[22] Filed: Jan. 18, 1991

[30] Foreign Application Priority Data

Jan. 30, 1990 [JP] Japan ..... 2-18092

[51] Int. Cl.[5] ..... A24B 3/14

[52] U.S. Cl. ..... 131/374; 131/370; 131/372; 131/357

[58] Field of Search ..... 131/370, 372, 374, 356, 131/357

[56] References Cited

U.S. PATENT DOCUMENTS 4,702,264 10/1987 Graves, Jr. ..... 131/370

4,754,767 7/1988 Graves, Jr. ..... 131/370

*Primary Examiner*—Vincent Millin
*Assistant Examiner*—Lynne A. Reichard
*Attorney, Agent, or Firm*—Nixon & Vanderhye

[57] ABSTRACT

A sheet tobacco producing apparatus comprises a mixer, a kneader, a crusher, and a shaping machine. The mixer mixes tobacco chips with auxiliary substances including water, to produce wet round pieces. The kneader has a pair of rollers for kneading the wet round pieces to form a sheet intermediate. The crusher crushes the sheet intermediate to form crushed wet round pieces. The shaping machine has a pair of rollers for forming a final sheet product from the crushed pieces. Since the tobacco raw material is deformed from the sheet intermediate which is obtained after once kneaded, to round pieces again, it is easy to take the material iinto the gap between the rollers of the shaping machine, whicn increases the manufacturing speed of the apparatus.

10 Claims, 5 Drawing Sheets

METHOD AND APPARATUS FOR PRODUCING SHEET TOBACCO

BACKGROUND OF THE INVENTION

1. Field of the Invention

This invention relates to a method for producing sheet tobacco to be used as a material of cigarettes or the like, and to an apparatus for executing the method. More particularly, it relates to a method for producing the sheet tobacco by bonding tobacco chips or small round pieces with an adhesive (those materials including tobacco powder which can constitute sheet tobacco will hereinafter be called "tobacco chips"), and an apparatus for executing the method.

2. Description of the Related Art

So-called cut tobacco is used as raw material of cigarettes or the like. In cutting process or other processes for making cigarettes, tobacco chips such as large and small chips, powder, or fibers of tobacco leaves are inevitably produced as the remnant. To recycle the tobacco chips, they are bonded together with an appropriate adhesive, mixed with a reinforcing material and a moisture retentive material, and rolled with rollers, thus obtaining sheet tobacco. The sheet tobacco is cut into small pieces, and then blended into new cut tobacco.

FIG. 2 shows a conventional sheet tobacco-manufacturing apparatus. In the apparatus, tobacco chips (i.e., raw material) are mixed, at a time, in a batch-type mixer 12, with an appropriate adhesive, and reinforcing and moisture-retentive materials, thereby producing wet small round pieces. These pieces are uniformly distributed to constant feeders 14 provided for, for example, ten processing lines (only two of them are shown in FIG. 2), respectively.

The wet small round pieces are kneaded by a kneader 16 provided in each processing line, and then supplied to a shaping machine 18, thereby producing a wet sheet of tobacco. Subsequently, the wet sheet is dried by radiant heat of a heater or hot air while they are transferred by a mesh conveyor 22, and then cut by a cutter 24 into pieces of a substantially predetermined size. The pieces are gathered from the lines, and packed by a packing machine 26.

FIGS. 3 and 4 show examples of the kneader 16 and shaping machine 18, respectively. The kneader 16 has two pairs of rollers 34–37 to be driven by a motor 32, one pair being aligned with the other pair in the vertical direction. The distances between the rollers 34 and 35 and between the rollers 36 and 37 are approx. 0.2 mm. The shaping machine 18 has a pair of rollers 44 and 45 to be driven by a motor 42. The distance between the rollers 44 and 45 is approx. 0 mm.

As is indicated by the arrows shown in FIG. 3, the wet small round pieces supplied from the mixer 12 are successively fed from the upper end of the kneader 16 to the first rollers 34 and 35. As is shown in FIG. 5, a predetermined amount of wet small pieces 10*a* is deposited on the rollers 34 and 35 at all times, and the pieces deposited is kneaded between the rollers in accordance with rotation thereof made in the directions indicated by the arrows, and discharged from between the rollers, thus obtaining a sheet intermediate 10*b*.

In the above process, the rollers 34 and 35 rotate at different speeds, and the sheet product 10*b* is discharged, while being attached to the surface of the roller 35 rotating at a higher speed than the other roller 34. A doctor blade 38 is provided on the roller 35 tears the sheet product 10*b* from the roller 35.

The sheet intermediate 10*b* torn from the surface of the roller 35 is fed to the second rollers 36 and 37 of the kneader 16, where it is kneaded as done between the first rollers 34 and 35. Then, the intermediate 10*b* is discharged therefrom.

Subsequently, the sheet intermediate is fed to the rollers 44 and 45 of the shaping machine 18, processed in a way similar to the above-described one, and discharged therefrom, as is indicated by the arrows shown in FIG. 4.

In the above-described apparatus, the speed at which the rollers 44 and 45 of the shaping machine 18 can take the sheet intermediate discharged from the kneader 16 into the gap herebetween is limited, which determines the manufacturing speed. Accordingly, to obtain high manufacturing efficiency, the apparatus must incorporate, for example, as many as ten process lines, as is described above.

To eliminate this disadvantage, a method has been proposed in which the wet pieces discharged from the mixer 12 are directly supplied to the shaping machine 18, without using the kneader 16. However, final sheet products obtained by this method tend to be cracked when they are torn from the rollers of the shaping machine 18 due to low intensity of them. The greater the rotational speed or feeding speed of the shaping rollers, the more liable the sheet product is to be cracked.

SUMMARY OF THE INVENTION

This invention has been made to solve the abovedescribed problems, and hence has the object to provide a method for producing sheet tobacco of high quality at high speed and an apparatus for executing the method.

To attain the above object, the present invention provides a method for producing sheet tobacco, comprising the steps of: producing wet round pieces by mixing tobacco chips with auxiliary substances including water; forming a sheet intermediate by kneading he wet round pieces; forming crushed wet round pieces by crushing the sheet intermediate; and forming a final sheet product by processing the crushed wet round pieces between at least one pair of rollers.

Further, according to another aspect of the invention, an apparatus for producing sheet tobacco is provided, comprising: a mixer for mixing tobacco chips with auxiliary substances including water to produce wet round pieces; a kneader having at least one pair of rollers for kneading the wet round pieces to form a sheet intermediate; a crusher for crushing the sheet intermediate to form crushed wet round pieces; and a shaping machine having at least one pair of rollers for forming a final sheet product from the crushed wet round pieces.

Preferably, each of the rollers of the shaping machine is a roller having a plurality of water passes formed therein in the vicinity of the surface of the roller.

According to the present invention, the tobacco raw material is crushed by the crusher before being supplied to the rollers of the shaping machine, which greatly increases the speed at which the material is taken into the gap between the rollers of the shaping machine. Accordingly, the shaping rollers can operate about three times faster than in the conventional case. In other words, for example, if the conventional apparatus requires ten processing lines to produce a certain amount of sheet tobacco per unit time, then the apparatus of the present invention requires only three processing lines to do the same work.

Further, the roller having a plurality of coolant passes formed therein is used as the shaping roller, thereby preventing excessive heat from being created by the shaping roller during high speed operation thereof. By virtue of this structure, the deterioration of products due to an increase in manufacturing speed can be avoided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
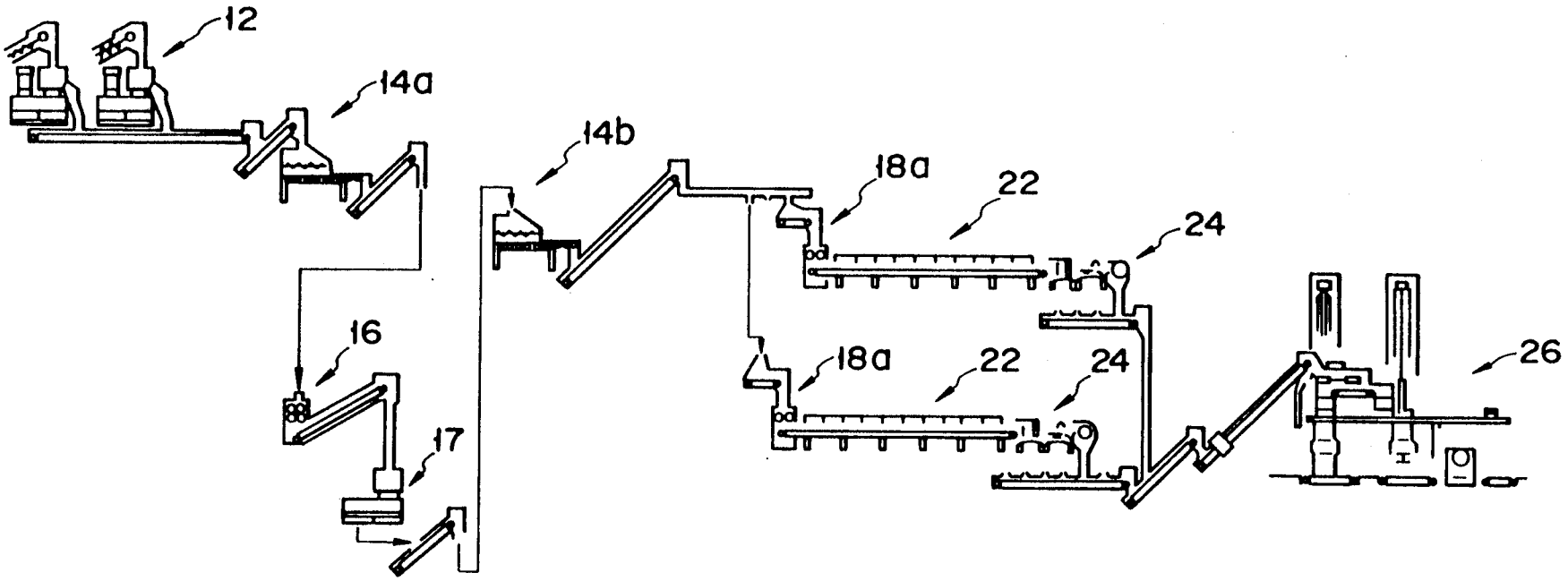
FIG. 1 is a schematic view, showing an embodiment of the present invention, i.e., showing the entire arrangement of an apparatus for producing sheet tobacco, and useful in explaining a method for producing it.

FIG. 1 shows the entire arrangement of an apparatus for producing sheet tobacco, according to the present invention.

First, tobacco chips as raw material are mixed with appropriate auxiliary substances, hereinafter referred to, in a batch-type mixer 12, thereby obtaining wet small round pieces having a diameter of approx. 2–5 mm. These pieces are discharged from the mixer 12 at a time, so that they are once gathered in a constant feeder 14*a* for successively feeding a predetermined amount of pieces, and then fed to a kneader 16 successively. This feeder 14*a* can be omitted if a successively-processing mixer is used in place of the batch-type mixer 12.

Figure 3:
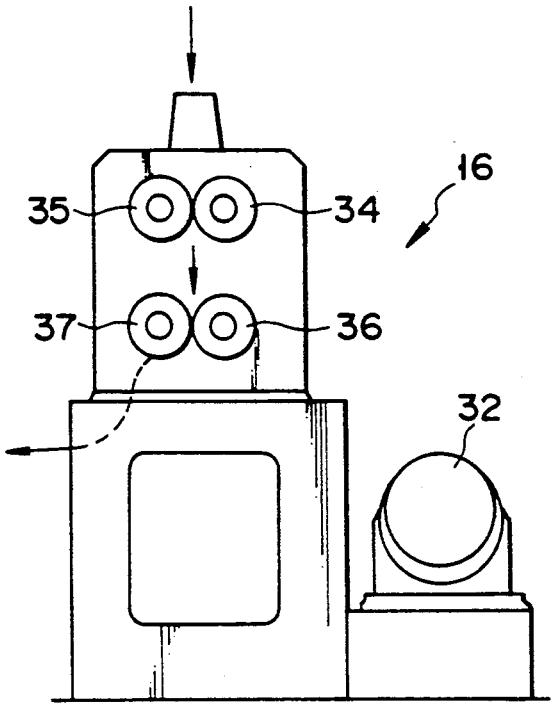
FIG. 3 is a schematic view of a kneader.

This kneader 16 is identical to the conventional one shown in FIG. 3. Thus, the wet small pieces are kneaded and discharged in the same way as described before. A sheet intermediate discharged from the kneader are supplied into a crusher 17, hereinafter referred to, where they are again divided into wet round pieces. Preferably, these pieces crushed have a diameter (approx. 2–5 mm) substantially identical to those discharged from the mixer 12. They are gathered in the feeder 14*b*, and then uniformly distributed to, for example, three process lines, only two of which are shown in FIG. 1.

Figure 4:
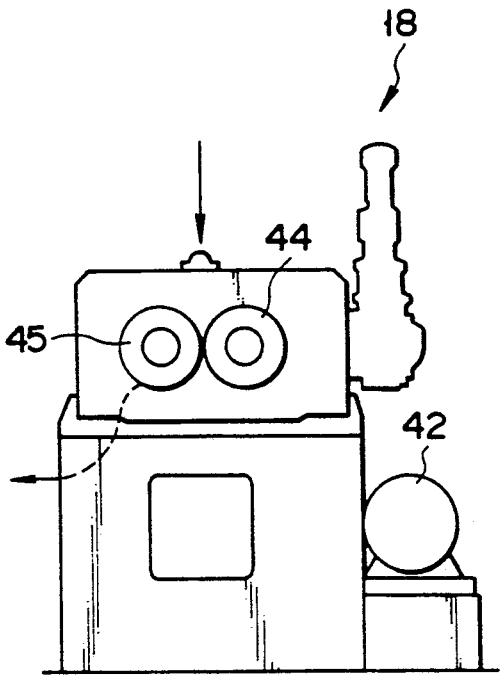
FIG. 4 is a schematic view of a shaping machine.
Figure 5:
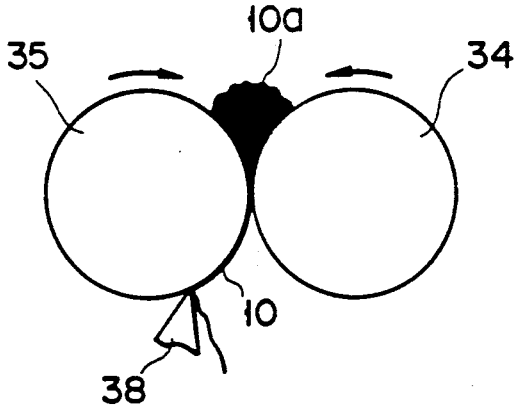
FIG. 5 is a view, showing the operation of rollers of the kneader.

Each of the lines is provided with a shaping machine 18*a* for forming a final sheet product from the crushed pieces. The machine 18*a* is identical to the conventional one shown in FIG. 4, except that it incorporates rollers each having a cooling mechanism arranged therein, hereinafter referred to. Thus, the pieces supplied into the shaping machine 18*a* is discharged therefrom in the same way as described before. However, the difference between the two shaping machines exists in that crushed small round pieces are fed into the shaping machine employed in the present invention, whereas a sheet intermediate is fed into the conventional shaping machine. Since it is easier to take the small round pieces into the gap between the rollers of the shaping machine than to take the sheet intermediate into the gap, the rollers of the shaping machine according to the present invention can be driven faster (about three-times faster at maximum) than those of the conventional shaping machine. Further, in the present invention, since the pieces kneaded by the kneader 16 and then crushed by the crusher 17 are supplied into the shaping machine 18*a*, where they are kneaded again, the final sheet product discharged from the machine 18*a* is very strong, and therefore, free from cracks caused when they are torn from the rollers.

The final sheet product is dried by radiant heat of a heater or hot air while they are conveyed by a mesh conveyor 22, and then roughly cut to have a predetermined size by a cutter 24. Finally, the final sheet products are gathered from all the lines, followed by being packed by a packing machine 26.

Some of the characterizing features of the abovedescribed apparatus will be explained in more detail.

Auxiliary substances

To produce sheet tobacco according to the present invention, wet small pieces are prepared, which are made by bonding tobacco chips with a binding material. Like the conventional raw material of cigarettes, the wet pieces contain tobacco chips of various kinds, a binding material, a reinforcing material and water for making them contain appropriate humidity, and if necessary, auxiliary substances such as a water holding agent and a water resisting agent. Preferably, the pieces contain reinforcing substances in an amount of 5–20 parts by weight and also water in an amount of 20–35 parts by weight, with respect to 100 parts of the tobacco chips. Also preferably, conventional pulp fiber are used as reinforcing substance. The content of the tobacco chips is 75–95% by weight, preferably 80–90% by weight, of the entire components except for water. Sodium carboxymethylcellulose, methylcellulose, ethylcellulose, starch, sodium alginate, or the like can be used as binding material. The content of the binding material is 1–15, preferably 3–10, parts by weight with respect to 100 parts by weight of the tobacco chips. A mixture of propylene glycol and corn syrup (the mixture rate: e.g. 1:2 by weight) can be used as the water holding agent, while glyoxal can be used as the water resisting agent. In the mixer 12, the components other than water are mixed first, and then mixed with water.

Crusher

Figure 6:
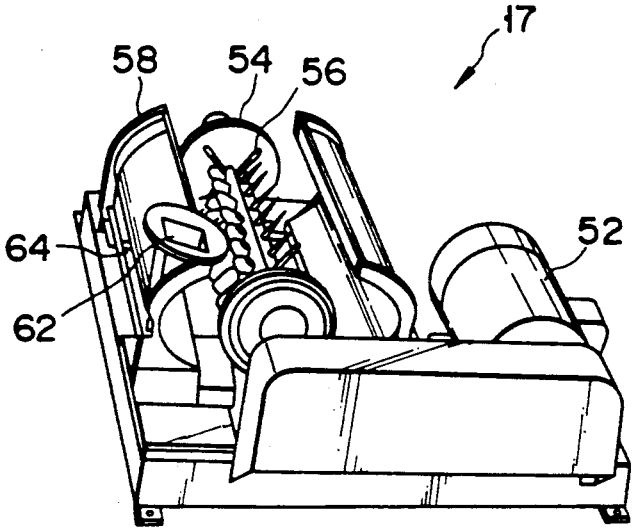
FIG. 6 is a schematic perspective view of a crusher.

FIG. 6 is an enlarged perspective view, showing the crusher 17. The crusher 17 comprises a motor 52, and a rotary body 54 to be driven by the motor 52 and having a shaft provided with four lines of paddles 56 radially extending. Each line of paddles extends in the longitudinal direction of the shaft, spaced from another line. The paddles of each line extend at right angles to the paddles of its adjacent lines. Semicylindrical covers 58 are provided on both sides of the rotary body 54, thereby defining a crushing space. An inlet 62 for introducing raw material is formed in one of the covers 58, while an output 64 for discharging the raw material is arranged on the lower side of the rotary body 54.

The sheet intermediate discharged from the kneader 16 is introduced into the crushing space through the outlet 62, and divided again, by the paddles of the rotary body 54, into wet round pieces similar to those discharged from the mixer 12. These wet pieces are discharged from the crusher 17 through the outlet 64 of the rotary body 54. At the crusher, the raw material are processed successively from introduction to discharge.

Shaping rollers

As is described above, in the apparatus of the present invention, the raw material is easily taken into the gap between the rollers of the shaping machine 18*a*, which enables the rollers to operate three times faster than the conventional rollers. However, high speed rotation of the rollers causes excessive heat on their friction surfaces, and hence local expansion thereof. This local expansion will invite irregularities in the thickness of the final sheet product discharged from the rollers, thus deteriorating the product.

Figure 7:
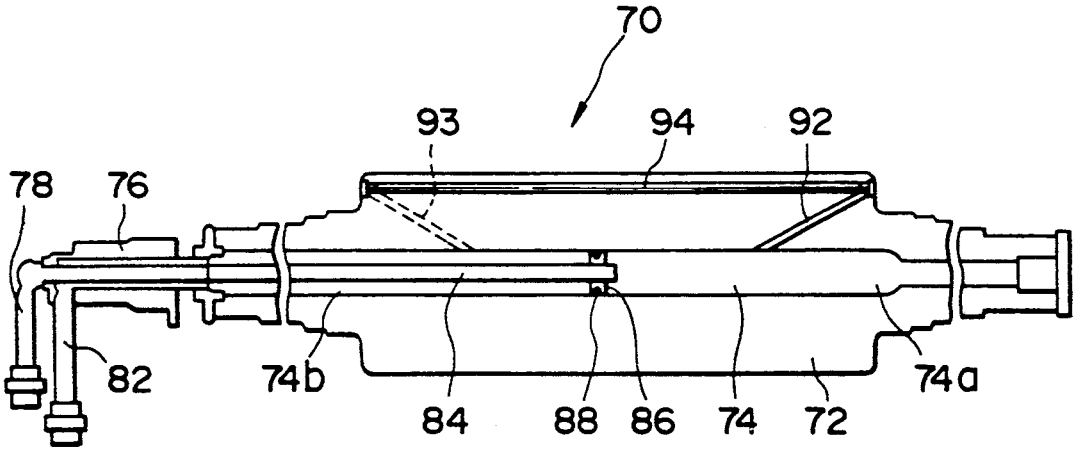
FIG. 7 is a longitudinal sectional view of a cooling mechanism incorporated a shaping roller.

FIG. 7 is a longitudinal sectional view of a roller 70 employed as the shaping roller in the present invention in order to solve the above-described problem. A roller body 72 of the roller 70 has a bore 74 extending therethrough in its axial direction. A rotary joint 76 is connected to one end of the roller body 72, and has a water-supply pipe 78 and a water-drainage pipe 82 both extending therethrough. The pipes 78 and 82 are connected to a water-introducing pipe 84 and a space 74*b* of the bore 74 (both hereinafter referred to) in a water-tight manner, respectively. Further, the pipes 78 and 82 extend coaxially at the junction of the bore 74 such that the pipe 82 encloses the pipe 78.

The water-supply pipe 78 has an end thereof connected to an end of a water-introducing pipe 84 arranged in the bore 74. The pipe 84 has the other end terminating at a substantial central portion of the bore 74. A partition plate 86 is provided around the terminating end of the introducing pipe 84, and divides the bore 74 into two spaces 74*a* and 74*b* (right and left spaces in the figure), together with an O-ring 88 fitted in an annular groove formed in the periphery of the partition plate 86.

Figure 9:
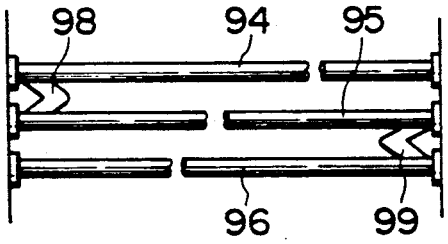
FIG. 9 is a view, useful in explaining how the water passages are arranged in the longitudinal direction.

A oblique water-pass 92 has an end communicating with the right space 74*a*, and the other end communicating with an end of a water-pass 94 axially extending in the roller body 72 in the vicinity of the upper surface thereof. As is shown in FIG. 9, the pass 94 has the other end connected to an end of an axial water-pass 95 via a connecting pass 98. The pass 95 has the other end connected to an end of an axial pass 96 via an introducing pass 99. The pass 96 has the other end connected to an oblique pass 93 communicating the left space 74*b* of the bore 74.

Figure 8:
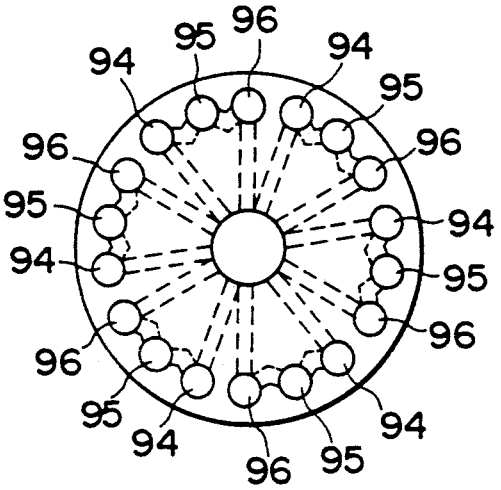
FIG. 8 is a view, useful in explaining how water passages incorporated in the cooling mechanism are arranged in the circumferential direction.

As can be understood from FIG. 8, six water passages each extending from the oblique pass 92 to the other oblique pass 93 through the axial passes 94–96 are provided in the shaping roller. That is, the axial passes 94–96 are formed in the roller in the vicinity of its peripheral surface such that they are arranged at substantially regular intervals in the circumferential direction. Water introduced from the water-supply pipe 78 flows into the right space 74*a* through the introducing pipe 84, and then into the axial passes 94–96 through the oblique pass 92, thereby cooling the entire surface of the roller body 72. Subsequently, water returns to the left space 74*b* via the oblique pass 93, and is exhausted from the roller through the drainage pipe 82.

At the start of the operation of the apparatus, hot water of appox. 60°–90° C. is supplied into the shaping roller 70 via the supply pipe 78. This is because the roller 70 must be heated at the start so as to allow raw material (i.e. wet round pieces here) to be sufficiently fluid. However, the water acts as a coolant when the roller becomes hot in accordance with high speed rotation thereof, thereby preventing the surface of the roller 70 from being excessively heated and hence from locally expanding. By virtue of this, the quality of the sheet product obtained can be maintained at high level.

The following is an experiment executed for comparing a product obtained by the method and apparatus of the present invention with products obtained by other methods and apparatuses:

EXAMPLE

Wet round pieces were made by mixing in the mixer 100 parts by weight of tobacco chips, 15 parts by weight of pulp fiber used as reinforcing material, a mixture of 5 parts by weight of propylene glycol and 5 parts by weight of corn syrup, which is used as water holding agent, 5 parts by weight of glyoxal used as water resisting agent, and 30 parts by weight of water for adjusting the humidity.

The pieces thus obtained were supplied from the mixer to a kneader, where they were kneaded and processed to a sheet intermediate having a thickness of approx. 0.5 mm. The peripheral speed ratio of a high speed roller to a low speed roller was 1.3:1, and the peripheral speed of the high speed roller was 138 m/min.

Then, the sheet intermediate was fed to a crusher, thereby obtaining wet round pieces having a diameter of approx. 3–5 mm. The rotational speed of a rotary body incorporated in the crusher was 800 rpm.

The product obtained by crushing was fed between rollers of a shaping machine, thereby forming a final sheet product having a thickness of 0.12 mm or so. The peripheral speed rate of a high speed roller of the shaping machine to a low speed roller of the same was 1.3:1, and the peripheral speed of the high speed roller was 240 m/min.

Figure 2:
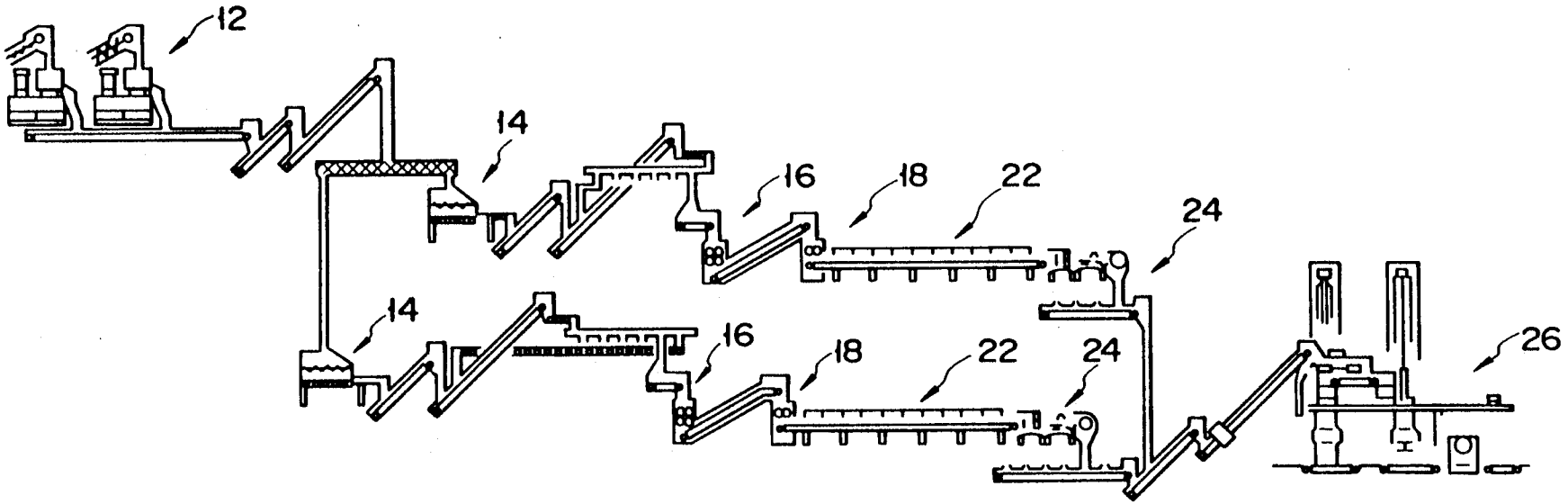
FIG. 2 (PRIOR ART)
FIG. 2 is a schematic view, showing the entire arrangement of a conventional apparatus.

The final sheet product was dried, and then subjected as sample A to a tensile strength test. Samples B and C were prepared as comparison sample under the following conditions:

Sample B was made by using a conventional apparatus as shown in FIG. 2, and therefore the manufacturing speed was about a third of that in the apparatus of the present invention. Sample C was made by an apparatus having no kneaders and a crusher with a rotary body whose rotational speed was set to 600 rpm, thereby making the manufacturing speed identical to that of the apparatus of the present invention. Table 1 below shows experimental results obtained from a tensile strength test carried out on the samples.

TABLE 1

| SAMPLE | TENSILE STRENGTH [g/mm²] LENGTHWISE | WIDTHWISE |
|---|---|---|
| A | 188.5 | 37.5 |
| B | 166.1 | 34.0 |
| C | 65.3 | 18.3 |

As can be understood from the above results, Sample A made by the method and apparatus according to the present invention has a tensile strength sufficiently greater than Sample B, and much greater than Sample C.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method for producing sheet tobacco, comprising the steps of:

producing wet round pieces by mixing tobacco chips with auxiliary substances including water;

forming a sheet intermediate by kneading the wet round pieces;

forming crushed wet round pieces by crushing the sheet intermediate; and forming a final sheet product by processing the crushed wet round pieces between at least one pair of rollers.

2. The method according to claim 1, wherein the wet round pieces are produced by a batch-type mixer, and a constant supply machine is used between the steps of producing the wet round pieces and of forming the sheet intermediate.

3. The method according to claim 1, wherein a constant supply machine is used between the steps of producing the crushed wet round pieces and of forming the final sheet product.

4. The method according to claim 1, wherein each of the rollers used in the step of producing the final sheet product is a roller having a plurality of water passes formed therein in the vicinity of the surface of the roller.

5. The method according to claim 4, wherein hot water is introduced into the water passes of each of the rollers, the hot water heating the crushed wet round pieces at the start of operation of the roller to thereby impart fluidity to the crushed wet round pieces, and cooling the roller at the time of high speed operation.

6. An apparatus for producing sheet tobacco, comprising:

a mixer for mixing tobacco chips with auxiliary substances including water to produce wet round pieces;

a kneader having at least one pair of rollers for kneading the wet round pieces to form a sheet intermediate;

a crusher for crushing the sheet intermediate to form crushed wet round pieces; and a shaping machine having at least one pair of rollers for forming a final sheet product from the crushed wet round pieces.

7. The apparatus according to claim 6, wherein the mixer is a batch-type mixer, and a constant supply machine is interposed between the mixer and the kneader.

8. The apparatus according to claim 6, wherein the crusher is provided with more than one shaping machine, and a constant supply machine is interposed between the crusher and the shaping machines

9. The apparatus according to claim 6, wherein the crusher has a rotary body provided with a plurality of paddles extending in radial directions, and the sheet intermediate is continuously fed onto the paddles, and then crushed by the paddles.

10. The apparatus according to claim 6, wherein each of the rollers of the shaping machine is a roller having a plurality of water passes formed therein in the vicinity of the surface of the roller.

* * * * *